United States Patent [19]

Champagne

[11] 4,039,159

[45] Aug. 2, 1977

[54] CONE HOLDER ASSEMBLY

[75] Inventor: Ralph R. Champagne, Woonsocket, R.I.

[73] Assignee: Rockwell International Corporation, Pittsburgh, Pa.

[21] Appl. No.: 677,519

[22] Filed: Apr. 16, 1976

[51] Int. Cl.[2] ..... B65H 49/02; D03J 5/08

[52] U.S. Cl. ..... 242/130.1

[58] Field of Search ..... 242/129.7, 130.1, 134, 242/130.2, 141

[56] References Cited

U.S. PATENT DOCUMENTS

| | | | |
|---|---|---|---|
| 1,306,256 | 6/1919 | Holt et al. | 242/130.1 |
| 2,914,271 | 11/1959 | Staufert | 242/130.2 |
| 3,210,024 | 10/1965 | Weiss | 242/130.1 |

FOREIGN PATENT DOCUMENTS

| | | | |
|---|---|---|---|
| 809,089 | 2/1937 | France | 242/130.1 |

*Primary Examiner*—Leonard D. Christian

[57] ABSTRACT

A cone holder for textile machines such as shuttleless looms for supporting a weft yarn supply package having a spindle member with a hub element fixed thereon. A resilient cap member having a plurality of circumferential deformable projections is carried by the hub with the projections being disposed so as to engage the inner surface of a cone for holding the latter on the spindle. A centering collar slidably carried on the spindle is biased by a spring element in a direction to cause the centering collar to engage another area of the interior surface of the cone so as to maintain the latter in a centralized position on the spindle.

1 Claim, 5 Drawing Figures

CONE HOLDER ASSEMBLY

BACKGROUND OF THE INVENTION

The invention pertains to a cone holder for textile machines and, more particularly, to an improved and simplified form of cone holder for so-called shuttleless looms.

In looms of the shuttleless type, that is, those looms in which weft yarn is supplied from an outside source and is not carried to and fro through the shed by the shuttle or carrier itself, it is common practice to utilize a cone holder at one side of the loom to support the supply of weft from which the required amounts are withdrawn during loom operation.

U.S. Pat. Nos. 3,165,279 and 3,897,915 and which are owned by the Assignee of the present application show and describe two distinct types of cone holders or so-called package holders for use in shuttleless looms of the type to which the present invention is applicable.

Cone holders utilized prior to the instant invention have performed their intended function with complete satisfaction; however, their complexity of design, and the number of elements required for each unit coupled with the cost of their manufacture has initiated many weaving mill requests for a more simplified and less expensive form of cone holder.

The device according to the present invention provides a cone holder which has satisfied the above described weaving mill requests. The device provides a simplified means for the donning and removal of a cone therefrom by simply slipping a cone of weft yarn onto said device where it is automatically positioned by a deformable gripping element and a centering member operatively associated with said gripping element. To doff or remove a cone from the device one simply has to apply a slight twist to the cone to effect the release of the holding properties of the gripping element.

SUMMARY OF THE INVENTION

The cone holder of the present invention includes an elongated spindle having a hub member fixed thereon at a location intermediate the ends of said spindle. A resilient cap member is attached to the hub member and includes a plurality of integral deformable circumferential projections which are adapted to engage a portion of the inner surface of a cone for holding the latter in position on the spindle. Additionally, a stabilizing means is slidably mounted on the spindle in spaced relation to the hub member. This stabilizing means is in the form of a centering collar having a coil spring interposed between it and the hub member. When a cone is placed on the spindle in a manner to be gripped and held by the circumferential projections of the resilient cap member, the coil spring is effective in locating the centering collar in a position to engage another area of the interior surface of a cone and to maintain said cone in a centralized position on the spindle while being held by said circumferential projections.

It is a general object of the invention to provide a cone holder for shuttleless looms that provides a positive locking fit within the weft package cone assembled thereon.

A further and more specific object of the invention is to provide a cone holder having a minimum number of parts, that is relatively inexpensive to manufacture, and which is readily adapted for assembly on existing shuttleless looms.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
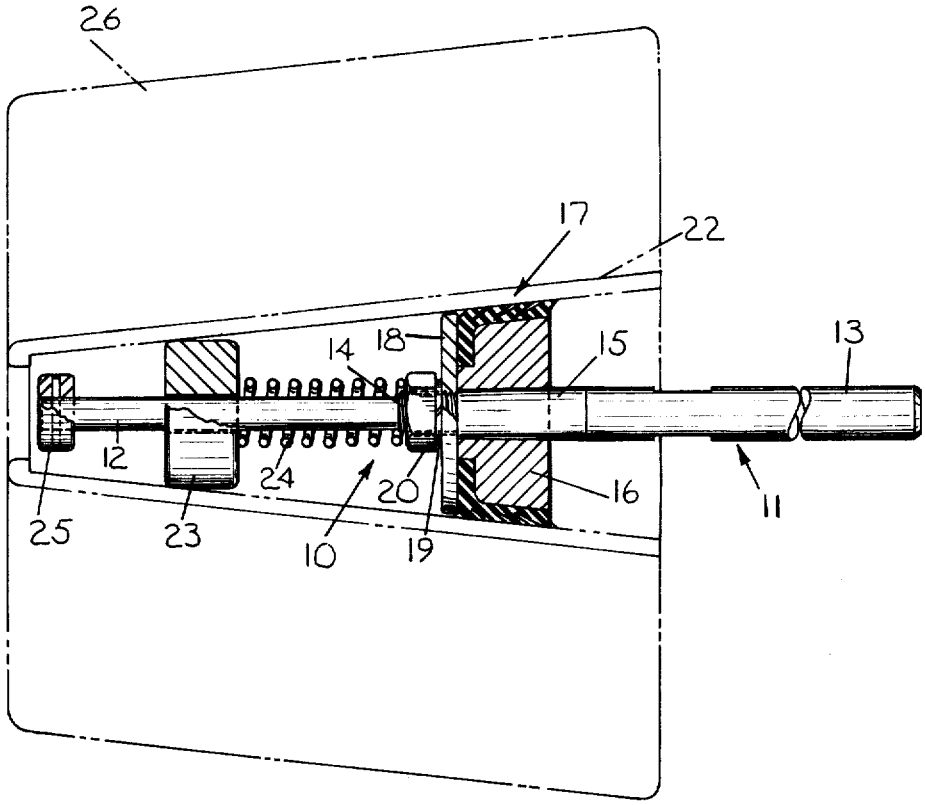
FIG. 1 is a view in side elevation and partially in section showing the various components of the invention and by means of phantom lines a weft supply cone mounted thereon.
Figure 5:
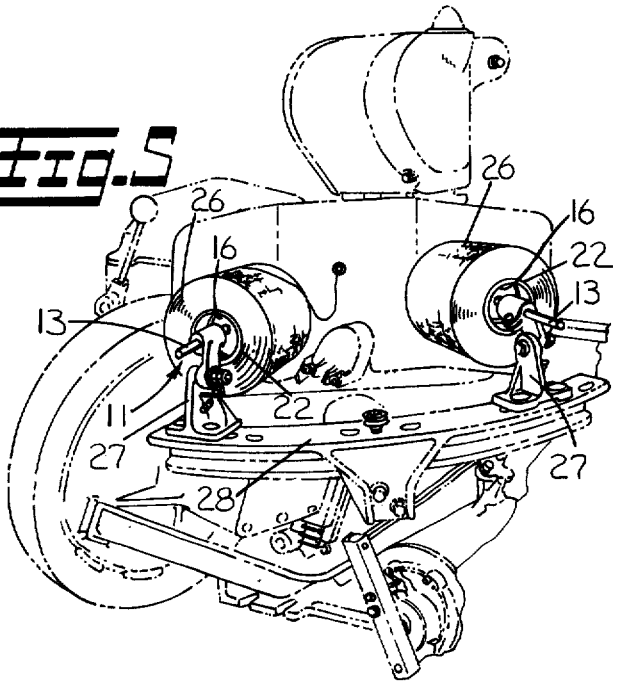
FIG. 5 is a perspective view of that portion of a shuttleless loom on which the weft supply cones are mounted.

In the embodiment shown in FIG. 5 only those parts of a shuttleless loom have been shown which are required for a complete understanding of the invention. In FIG. 1 the cone holder according to the invention is identified generally by numeral 10 and includes among other parts an elongated spindle depicted by numeral 11. This spindle 11 is formed by machining approximately one half of its longitudinal length to a diameter less than the remainder of the spindle. Numeral 12 identifies that portion of the spindle of reduced diameter and numeral 13 that portion of larger diameter. That portion 13 of the spindle which joins portion 12 is threaded for a part of its longitudinal length as at 14 and contiguous with this threaded part 14 portion 13 is tapered in the area indicated by numeral 15 (FIG. 1).

A hub member 16 is fixed on the tapered area 15 of the spindle 11 and is formed with a tapered outer periphery that conforms to the internal configuration of a cone.

A resilient cap member identified generally by numeral 17 is assembled on the outer periphery of the hub member 16 and the combination of both members are maintained in a fixed position on the spindle 11 by means a disc 18. This disc 18 is clamped against one end of the hub member 16 and the resilient cap 17 by means of a lock washer 19 and a hex nut 20 which are assembled on the threaded part 14 of the spindle 11.

Figure 2:
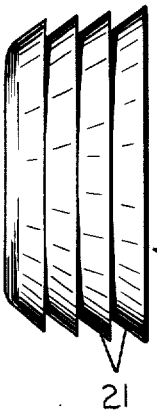
FIG. 2 is a view in side elevation showing the resilient cap member and its plurality of circumferential projections.
Figure 3:
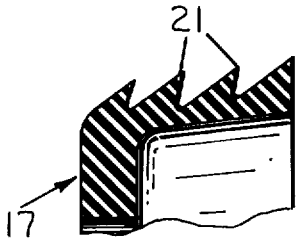
FIG. 3 is a sectional view of a portion of the resilient cap in FIG. 2.
Figure 4:
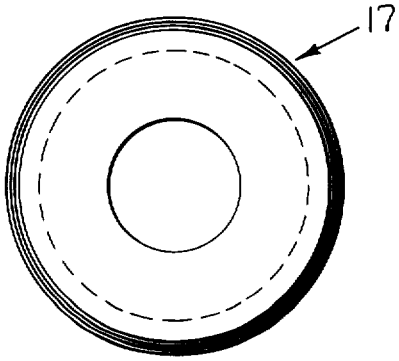
FIG. 4 is an end view of the resilient cap shown in FIG. 2.

The resilient cap 17 is fabricated from an elastomeric material and as shown is FIGS. 2 and 3 is provided with a plurality of integral deformable projections 21 which serve to engage the inner surface of a cone 22 for holding the latter on the spindle 11. To maintain the cone 22 in a centralized position on the spindle, while it is being held by the circumferential projections 21, a stabilizing means is provided which is carried by the spindle in operative association with the hub 16 and the resilient cap member 17. This stabilizing means includes a centering collar 23 (FIG. 1) slidably mounted for axial movement on the spindle 11. A coil spring 24 is also carried by the spindle 11 and is disposed intermediate the centering collar 23 and the hex nut 20 that serves to fix the hub member 16 on said spindle. To prevent removal of the centering collar from the spindle 11, the free end of that portion of the spindle depicted by numeral 12 has any suitable retaining means fixed thereon such as a collar 25.

Referring now to FIG. 5 two weft yarn supply packages 26 are shown supported by the cone holders 10 comprising the invention. In this Figure of drawing that portion 13 of the spindle 11 is shown mounted on the usual form of adjustable support stand 27 which in turn is carried by the conventional arcuated section of framework 28.

To summarize the operation, a cone of weft yarn is pushed onto the spindle 11 to a position where the deformable projections 21 engage the inner surface of the cone and firmly locate the latter on said spindle. During the donning of a cone onto the spindle, the coil spring 24 is effective in locating the centering collar 23 so that it engages another portion of the interior surface of the cone, whereby the later is maintained in a centralized position on said spindle while being held by the projections 21.

As heretofore described to remove a cone an operator simply has to turn it slightly which releases the hold of the circumferential projections 21 on the interior surface of the cone.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A cone holder for supporting a yarn package on textile machines which comprises:

a. an elongated spindle member;

b. a cone support means fixed on said spindle intermediate the ends thereof;

c. means defining a resilient cap member carried on said support means which includes:

i. means forming a plurality of integral deformable circumferential projections for holding a yarn package cone on said spindle member and selectively releasing the same therefrom; and d. stabilizing means slidably mounted on said spindle in operative association with said support means for maintaining the cone in a centralized position on said spindle while being held by said circumferential projections which include:

i. a centering collar and a biasing means interposed between said cone support means and centering collar for urging the latter to a position for engaging an inner surface of a cone spaced from that portion of the surface engaged by said circumferential projections.

* * * * *